US010337219B2

(12) United States Patent
Wolf et al.

(10) Patent No.: US 10,337,219 B2
(45) Date of Patent: Jul. 2, 2019

(54) LOCKING BOLT WITH SURFACE-MOUNTED TRANSMISSION

(71) Applicant: Truth Hardware, Owatonna, MN (US)

(72) Inventors: Glen M. Wolf, Owatonna, MN (US); David L. Snyder, Glenville, MN (US)

(73) Assignee: TRUTH HARDWARE, Owatonna, MN (US)

( * ) Notice: Subject to any disclaimer, the term of this patent is extended or adjusted under 35 U.S.C. 154(b) by 882 days.

(21) Appl. No.: 14/841,443

(22) Filed: Aug. 31, 2015

(65) Prior Publication Data

US 2017/0058579 A1 Mar. 2, 2017

(51) Int. Cl.

| | |
|---|---|
| ***E05C 9/18*** | (2006.01) |
| ***E05B 65/00*** | (2006.01) |
| ***E05C 9/04*** | (2006.01) |
| *E05B 63/06* | (2006.01) |
| *E05B 13/00* | (2006.01) |

(52) U.S. Cl.

CPC ..... *E05C 9/046* (2013.01); *E05B 65/0085* (2013.01); *E05C 9/041* (2013.01); *E05C 9/185* (2013.01); *E05B 13/004* (2013.01); *E05B 63/06* (2013.01)

(58) Field of Classification Search

CPC ..... Y10T 292/0834; Y10T 292/0836; Y10T 292/0837; Y10T 292/084; Y10T 292/0843; Y10T 292/0844; Y10T 292/0846; Y10T 292/0856

USPC ..... 292/32, 33, 39, 42

See application file for complete search history.

(56) References Cited

U.S. PATENT DOCUMENTS

| | | | | | |
|---|---|---|---|---|---|
| 1,338,689 | A * | 5/1920 | Massoll | E05B 17/007 | 292/147 |
| 2,179,728 | A * | 11/1939 | Peremi | E05C 9/021 | 292/39 |
| 3,183,027 | A * | 5/1965 | Powers | E05C 9/02 | 292/254 |
| 3,919,808 | A * | 11/1975 | Simmons | E05C 7/04 | 292/40 |
| 4,005,886 | A * | 2/1977 | Lirette | E05C 7/06 | 292/177 |
| 4,099,753 | A * | 7/1978 | Gwozdz | E05B 65/104 | 292/1.5 |
| 4,476,700 | A * | 10/1984 | King | E05C 9/041 | 292/39 |
| 4,554,807 | A * | 11/1985 | Dolejs | E05B 13/002 | 70/208 |
| 5,029,909 | A * | 7/1991 | Bunger | E05B 67/383 | 292/40 |

(Continued)

*Primary Examiner* — Carlos Lugo

(57) ABSTRACT

An apparatus has an actuator housing with a transmission side that defines a transmission slot. A slider is disposed in the actuator housing and has first and second ends which define a post receiver. The slider is movable between a first and second position. The post receiver is aligned with the slot when the slider is in the first position and the second position. A lever pivotably connected to the actuator housing is configured to move the slider from the first position to the second position. The transmission has an elongate element with a first and second end which is disposed outside the actuator housing and substantially parallel to and proximate the transmission side. A post extends from the first end and is received in the post receiver. A locking element is disposed proximate the second end of the first elongate element.

15 Claims, 12 Drawing Sheets

(56) References Cited

U.S. PATENT DOCUMENTS 5,046,767 A * 9/1991 Muscat ..... B60J 7/1851 292/34
5,184,852 A * 2/1993 O'Brien ..... E05B 65/1006 292/153
5,201,557 A * 4/1993 Schlack ..... E05B 5/00 292/161
5,290,077 A * 3/1994 Fleming ..... E05B 65/087 292/341.11
5,301,987 A * 4/1994 Tokarz ..... B60J 7/185 292/39
5,370,428 A * 12/1994 Dreifert ..... E05C 9/185 292/161
6,007,114 A * 12/1999 Hotzl ..... E05C 9/042 292/165
6,039,365 A * 3/2000 Rogatnev ..... F16B 37/0857 292/318
6,155,615 A 12/2000 Schultz
6,182,483 B1 * 2/2001 von Kathen ..... E05B 1/0092 292/336.3
6,485,070 B1 11/2002 Schultz
6,637,785 B2 * 10/2003 Sugimoto ..... E05B 13/002 292/302
6,957,513 B2 * 10/2005 Pettit ..... E05B 5/003 292/141
D514,426 S 2/2006 Eenigenburg
7,013,603 B2 3/2006 Eenigenburg et al.
D520,341 S 5/2006 Eenigenburg
7,070,211 B2 7/2006 Polowinczak et al.
7,171,784 B2 2/2007 Eenigenburg
D553,947 S 10/2007 Flory
D554,473 S 11/2007 Flory
7,421,868 B2 * 9/2008 Matyko ..... E05C 9/042 292/39
7,481,470 B2 1/2009 Eenigenburg et al.
7,607,262 B2 10/2009 Pettit et al.
7,976,077 B2 7/2011 Flory et al.
8,020,904 B2 9/2011 Flory et al.
8,132,369 B2 3/2012 Pettit et al.
8,181,393 B2 * 5/2012 Talpe ..... E05B 65/1006 292/142
8,899,635 B2 * 12/2014 Nakanishi ..... E05B 63/0056 292/194
2014/0353989 A1 * 12/2014 Nelson ..... E05B 15/0245 292/341.18
2015/0052817 A1 * 2/2015 Bourgoin ..... E05D 15/04 49/394
2016/0153218 A1 * 6/2016 Kondi ..... E05B 17/2053 292/142
2017/0058578 A1 3/2017 Wolf

* cited by examiner

LOCKING BOLT WITH SURFACE-MOUNTED TRANSMISSION

INTRODUCTION

Typical twin bolt locks can be used to lock bi-fold, sliding, or other doors. Such locks typically include a centrally-located actuator installed within a mortise of a door panel. One or more transmissions extend from the actuator to remotely located locking elements that extend into a header and/or sill of the door frame. These transmissions are disposed in a full-edge route along the edge of the panel or a hollow channel within the panel. This can prove difficult for certain types of doors. For example, door panels that utilize a skinned face over a wood sub-frame cannot include an edge route or hollow channel. Hollow stile door panels also will not allow a mortised manual lock bolt to be employed for locking due to the internal stiffening support members blocking or interfering with the transmission. With these types of doors, the external stile surface is typically not compatible with a recessed face mount shoot bolt. Solid panels are also difficult to fabricate or machine so as to allow the twin bolt system to run internally within the panel.

SUMMARY

In one aspect, the technology relates to an apparatus having: an actuator housing having a transmission side, wherein the transmission side defines a transmission slot; a first slider disposed in the actuator housing, wherein the first slider includes a first end and a second end defining a post receiver, wherein the first slider is movable between a first position and a second position, and wherein the post receiver is aligned with the slot when the first slider is in the first position and the second position; a lever pivotably connected to the actuator housing and configured to move the first slider from the first position to the second position; a first transmission having: a first elongate element having a first end and a second end, wherein the first elongate element is disposed outside the actuator housing and substantially parallel to and proximate the transmission side; and a post extending from the first end and received in the at least one post receiver; and a first locking element disposed proximate the second end of the first elongate element. In an embodiment, the first locking element includes the second end of the elongate element. In another embodiment, the first locking element includes a shoot bolt connected to the second end of the elongate element. In yet another embodiment, the shoot bolt defines a transmission receiver for receiving at least a portion of the transmission. In still another embodiment, the portion of the transmission includes a serration.

In another embodiment of the above aspect, the first locking element further includes a shoot bolt housing, wherein the shoot bolt is slidably disposed in the shoot bolt housing. In an embodiment, the transmission receiver projects from a transmission side of the shoot bolt housing. In another embodiment, the transmission side of the shoot bolt housing is substantially parallel to the transmission side of the actuator housing. In yet another embodiment, the shoot bolt is configured to substantially extend from the shoot bolt housing when the first slider is in the first position and wherein the shoot bolt is configured to substantially retract into the shoot bolt housing when the first slider is in the second position. In still another embodiment the lever is connected to the first slider with a linkage.

In another embodiment of the above aspect, the linkage includes a second slider disposed in the housing and connected to the lever, wherein the second slider includes a rack disposed proximate a first end of the second slider and defines at least one post receiver proximate a second end of the second slider. In an embodiment, the first slider includes a rack disposed proximate the first end of the first slider and wherein the linkage further includes a gear engaged with the rack of the first slider and the rack of the second slider. In another embodiment, the apparatus further has: a second transmission having: a second elongate element disposed outside the housing and substantially parallel to and proximate the transmission side; and a post connected to the second elongate element at a first end and received in the at least one post receiver; and a second locking element disposed proximate a second end of the second elongate element.

In another aspect, the technology relates to an apparatus having: an actuator housing having a transmission side, wherein the transmission side defines at least one transmission slot; a pair of sliders disposed in the actuator housing, wherein each slider includes a rack disposed proximate a first end and at least one post receiver disposed proximate a second end; a gear engaged with both the rack of the first slider and the rack of the second slider; a lever pivotably connected to the housing and engaged with at least one of the pair of sliders, wherein the lever is movable between a first position and a second position; a pair of shoot bolt housings, each including a transmission side, wherein each of the shoot bolt housings are disposed remote from the actuator housing; a shoot bolt slidably disposed in each of the shoot bolt housings, wherein the shoot bolts each include a transmission receiver projecting from the transmission side of the shoot bolt housings; a first transmission engaged with the post receiver on a first of the pair of sliders and the transmission receiver on a first of the pair of shoot bolt housings, wherein the first transmission is disposed on the transmission sides of the actuator housing and the first shoot bolt housing; and a second transmission engaged with the post receiver on a second of the pair of sliders and the transmission receiver on a second of the pair of shoot bolt housings, wherein the second transmission is disposed on the transmission sides of the actuator housing and the second shoot bolt housing. In an embodiment, each of the pair of sliders includes a plurality of post receivers. In another embodiment, each transmission includes an elongate element having a serrated end and wherein each transmission receiver includes a recess having a serrated profile configured to mate with the serrated end. In yet another embodiment, a cover defines a channel, wherein the channel is configured to at least partially receive at least one of the first transmission and the second transmission: when the actuator housing and pair of shoot bolt housings are installed in a door panel; and when the first transmission and the second transmission are disposed external to an edge of the door panel. In still another embodiment a lock for selectively locking the lever is in the first position.

In another aspect, the technology relates to a method including: forming an actuator recess in a face of a door panel; installing an actuator housing in the actuator recess; forming a shoot bolt recess in an edge of the door panel; installing a shoot bolt housing in the shoot bolt recess; and disposing a transmission along the edge of the door panel, wherein the transmission engages an actuator disposed in the actuator housing and a portion of a shoot bolt extending from the shoot bolt housing. In an embodiment, the method further includes securing a cover to the edge of the door panel so as to at least partially cover the transmission.

BRIEF DESCRIPTION OF THE DRAWINGS

There are shown in the drawings, examples which are presently preferred, it being understood, however, that the technology is not limited to the precise arrangements and instrumentalities shown.

DETAILED DESCRIPTION

Figure 1:
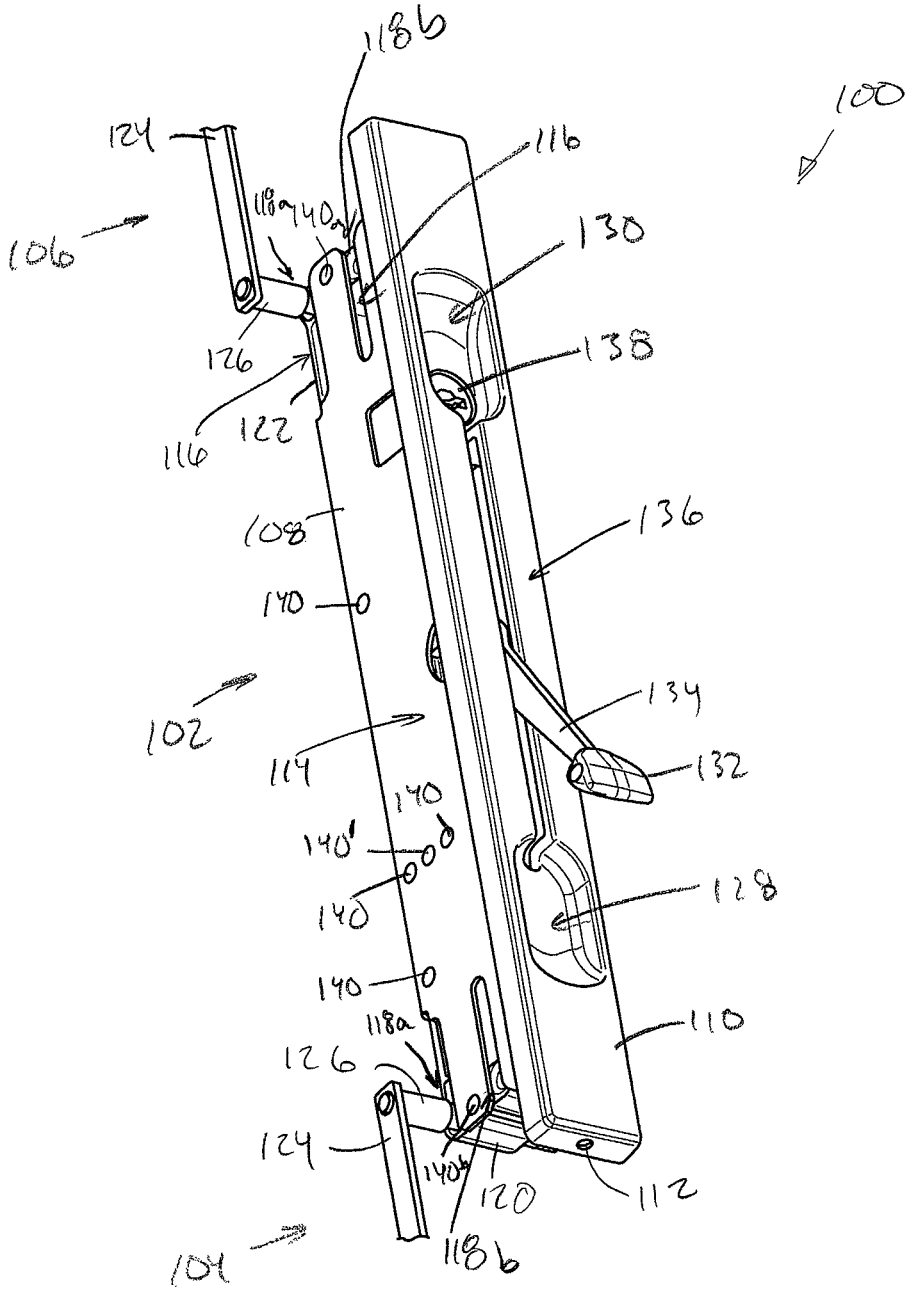
FIG. 1 is a partial perspective view of a lock.

FIG. 1 is a partial perspective view of a lock 100. Specifically, the lock 100 includes an actuator 102 and a plurality of transmissions 104, 106 that drive remote locking elements (not shown). The actuator 102 includes an actuator housing 108 that defines an interior void in which a number of elements are disposed. These elements are described elsewhere herein. An escutcheon or faceplate 110 is secured to the housing 108 via one or more set screws 112. The housing 108 includes a transmission side 114 proximate which the transmissions 104, 106 are disposed. The housing 108 defines a plurality of transmission slots 116. The transmission slots 116 are aligned with post receivers 118*a*, 118*b* on sliders 120, 122 disposed within the housing 108. In the depicted example, each slider 120, 122 includes two post receivers 118*a*, 118*b*. The sliders 120, post receivers 118*a*, 118*b*, and other components internal to the housing 108 are described elsewhere herein. Each transmission 104, 106 is engaged with one of the sliders 120, 122, respectively. More specifically, each transmission 104, 106 includes an elongate element 124, which may be a rigid bar, tube, rod, or other element, as well as a post 126 extending therefrom. The posts 126 are configured to engage the sliders 120, 122, via insertion into the post receivers 118*a*. As such, movement of the sliders 120, 122 ultimately moves the transmissions 104, 106.

The escutcheon 110 defines a plurality of recesses 128, 130, that are configured to receive a handle 132 of a lever 134 that actuates the lock 100. The recess 128 is sized such that the handle 132 will be substantially flush to a face 136 of the escutcheon 110 when the lever 134 is in a first position, where the lock 100 is locked. The lock 100 of FIG. 1 is in the locked position, since the sliders 120, 122 are at their maximum extent within the housing 108, but the lever 134 is depicted slightly raised for clarity. When in the locked position, a locking tumbler 138 is exposed in recess 130, enabling complete locking of the lock 100 with a key (not shown). When the tumbler 138 is locked, movement of the sliders 120, 122 is not possible. With the tumbler 138 unlocked, the lever 134 may be pivoted P to a second position where the handle 132 is disposed in the recess 130. With the lever 134 in this second position, the lock 100 is unlocked (and the sliders 120, 122 are disposed at their minimum extent within the housing 108). The locked and unlocked conditions of the lock 100, and the respective positions of components within the housing 108 are described herein. Since the transmissions 104, 106 are engaged with their respective slider 120, 122, the position of the sliders 120, 122 control the position of the transmissions 104, 106. A number of pins 140 secure the housing 108 and act as guides or supports for a number of internal components.

Figure 2:
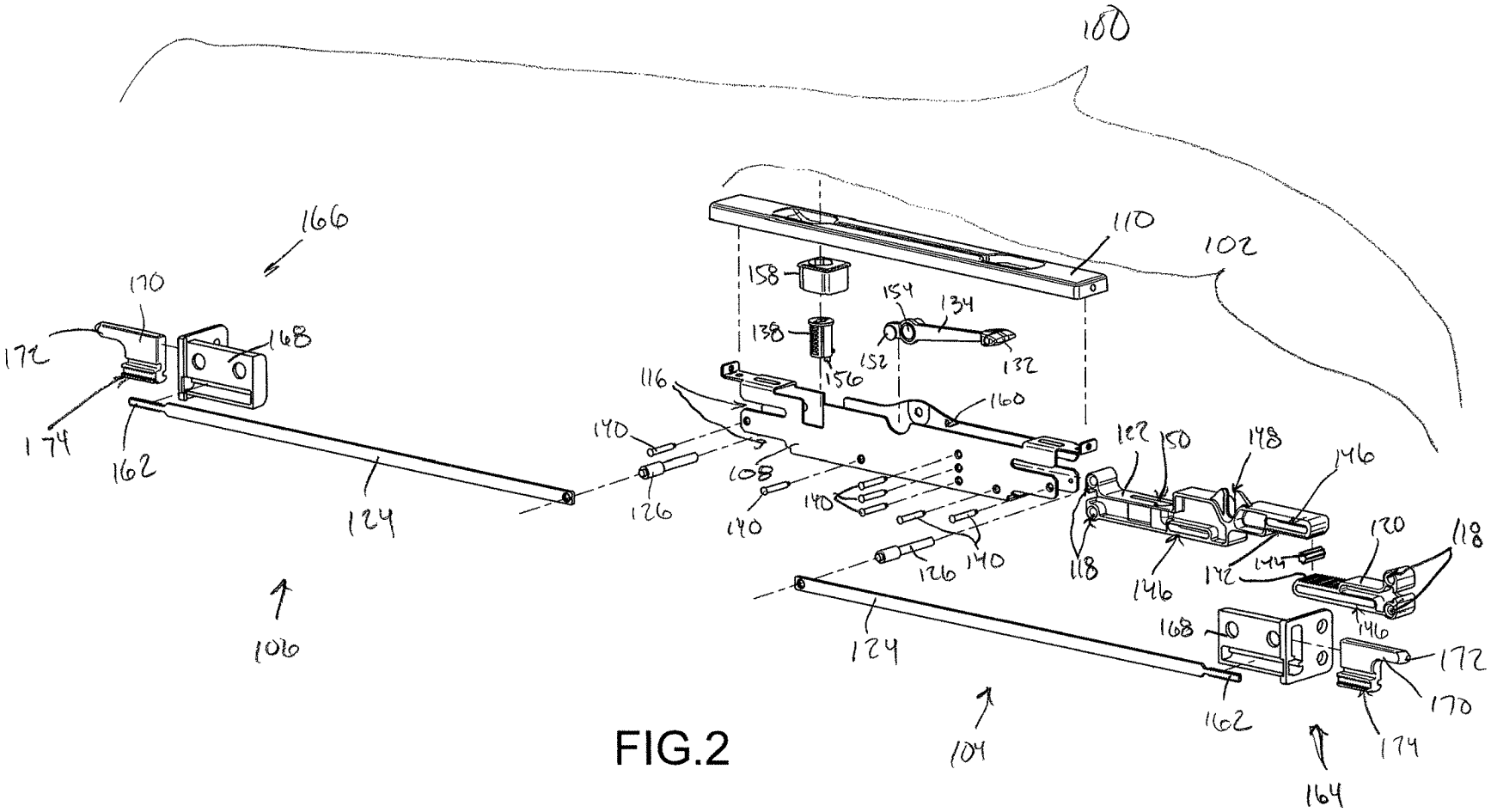
FIG. 2 is an exploded perspective view of a lock having surface-mounted transmissions.

FIG. 2 is an exploded perspective view of a lock 100 having surface-mounted transmissions 104, 106. A number of components depicted in FIG. 2 are described above with regard to FIG. 1 and, as such, are not necessarily described further. The interactions between a number of these components are described below. Each slider 120, 122 defines a rack 142 on first ends thereof. A gear 144 is disposed between the two racks. Additionally, each slider 120, 122 defines a plurality of slots 146 through which pins 140 are inserted. The interaction between the pins 140 and the slots 146 guides the sliders 120, 122 smoothly during operation. Slider 122 includes a drive slot 148, as well as a locking slot 150. The lever 134 includes a drive 152 disposed on an end of the lever 134 opposite the handle 132. The lever 134 is connected to the housing 108 at a pivot 154. The tumbler 138 includes a tailpiece 156 and a tumbler housing 158 that supports the tumbler 138. The housing 108 may be a stamped piece of metal that, when fully formed, defines an interior void 160. Each transmission 104, 106 includes a bar 124 that terminates a serrated tip 162. Locking elements 164, 166 are disposed remote from the actuator 102 and include a shoot bolt housing 168 and a shoot bolt 170 slidably disposed therein. Each shoot bolt 170 includes a tip 172 and defines a transmission receiver 174 that has a configuration that enables engagement with the serrated tip 162 of the bar 124. In other example, the tip 162 may act as the locking element without need for the shoot bolt. In such an example, the shoot bolt and housing may be eliminated and the tip 162 may be manufactured to a length that will allow it to extend into the head and/or sill.

Figure 3A:
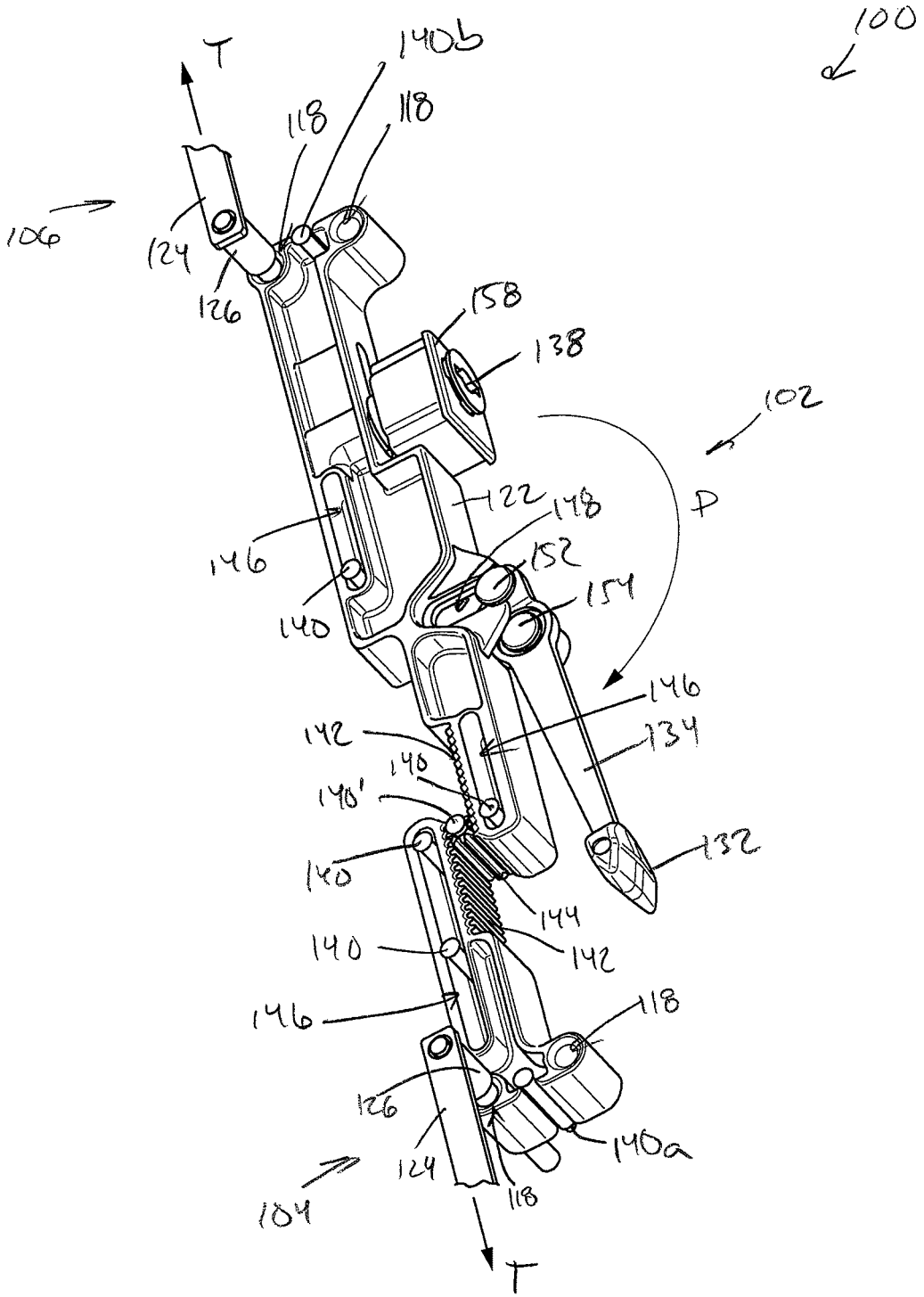
FIGS. 3A and 3B are partial perspective views of the lock of FIG. 2 in locked and unlocked positions, respectively.
Figure 3B:
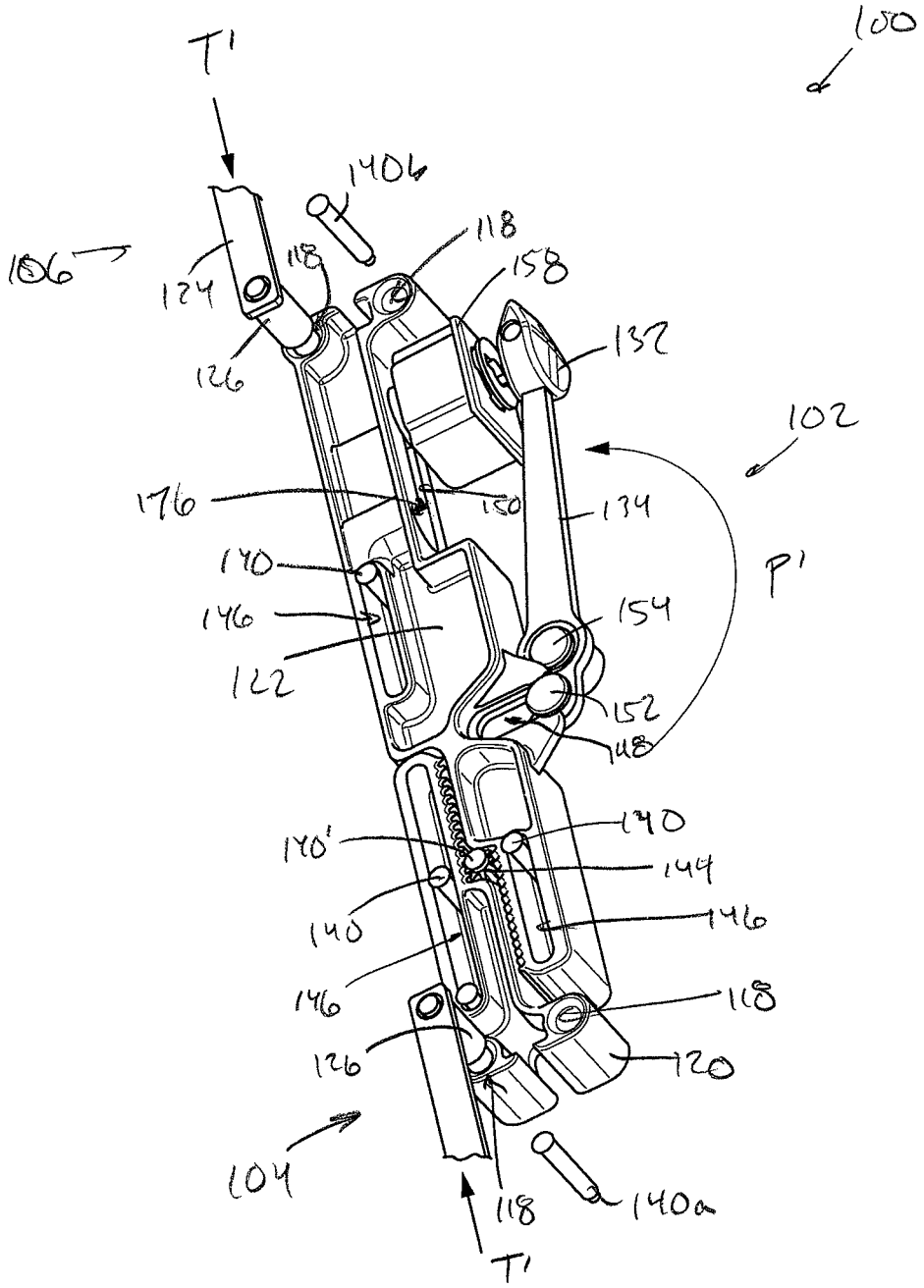

FIGS. 3A and 3B are partial perspective views of the lock 100 of FIG. 2 in locked and unlocked positions, respectively. In FIGS. 3A and 3B, the housing and escutcheon of the actuator 102 are not depicted so as to show operation of the internal components thereof. FIGS. 3A and 3B are described generally simultaneously. A number of elements are depicted above with regard to FIGS. 1 and 2 and as such are not necessarily described further. As described above, a number of components are fixed relative to the housing. Specifically pins 140 hold and/or guide the movement of a number of components within the housing. Pin 140', specifically, forms an axis about which the gear 144 rotates as the racks 142 on the first slider 120 and the second slider 122 move from the first position of FIG. 3A to the second position of FIG. 3B. Pins 140*a*, 140*b* secure the housing at the ends thereof, and are depicted in both figures to show movement of the sliders 120, 122 relative to the housing. The lever 134 pivots P about a pivot 154. The drive 152 extends into the elongate drive slot 148 on the second slider 122. When the lever 134 is pivoted into the locked position of FIG. 3A, the bars 124 of the transmissions 104, 106 are translated T to their furthest extended positions, so as to lock the door on which the lock 100 is installed by extending the shoot bolt (not depicted). With the handle 132 of the lever 134 in this position, the actuator 102 may be locked at the tumbler 138. Locking the tumbler 138 rotates the tailpiece 156 (not visible in FIGS. 3A and 3B) into a lock region 176 of the locking slot 150, thus preventing movement of the slider 122. Since the slider 122 is engaged with the transmission 106 and the transmission 104 (via a linkage formed by the gear 144 and the slider 120), actuation of the lever 134 into the unlocked position is prevented.

To unlock the lock 100, the tumbler 138 is first turned to an unlocked position, thus moving the tailpiece (not visible) thereof out of the lock region 176 of the slot 150. The lever 134 may then be pivoted P' (FIG. 3B). This pivoting P' moves the drive 152 towards an end of the elongate drive slot 148, then (as the lever 134 passes a position substantially parallel with the slot 148), away from the end of the drive slot 148. Since the lever 134 is fixed to the housing at pivot 154, this moves the slider 122 away from the pin 140*b*. Engagement of the rack 142 of the slider 122 rotates the gear 144, which, in turn, moves the slider 120, due to engagement between the gear 144 and rack 124 on the slider 120. Movement of the slider 120 is away from the pin 140*a*. As the sliders 120, 122 move away from their respective limit pins 140*a*, 140*b*, the transmissions 104, 106 translate in a direction T', which unlocks the door on which the lock 100 is installed.

Figure 4:
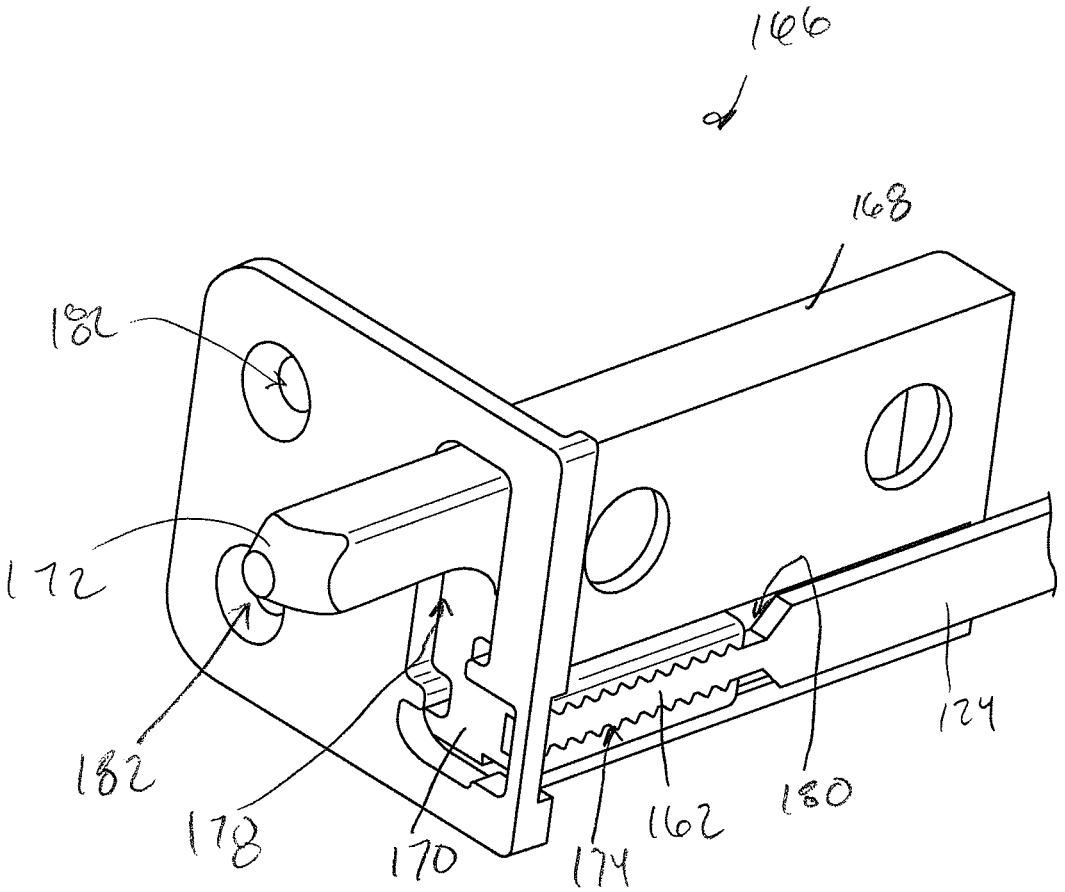
FIG. 4 is a partial perspective view of the locking element of the lock of FIG. 2.

FIG. 4 is a partial perspective view of the locking element 166 of the lock of FIG. 2. In general, both locking elements 164, 166 are substantially identical, mirror images of each other. As such, the locking element 164 includes the same components as depicted and described in FIG. 4. The locking element 166 includes a housing 168 that defines a recess 178 for receiving the shoot bolt 170. The housing 168 also defines a transmission receiver slot 180 through which the transmission receiver 174 of the shoot bolt 170 extends. By extending through the transmission receiver slot 180, the transmission receiver 174 is able to engage with the serrated tip 162 on the bar 124. FIG. 4 depicts the locking element 166 in the locked position, where the tip 172 of the shoot bolt 170 extends substantially from the housing 168. In the unlocked position, the tip 172 of the shoot bolt 170 is retracted substantially into the housing 168. Apertures 182 are defined by portions of the housing 168 so as to allow securement thereof to a door panel.

Figure 5A:
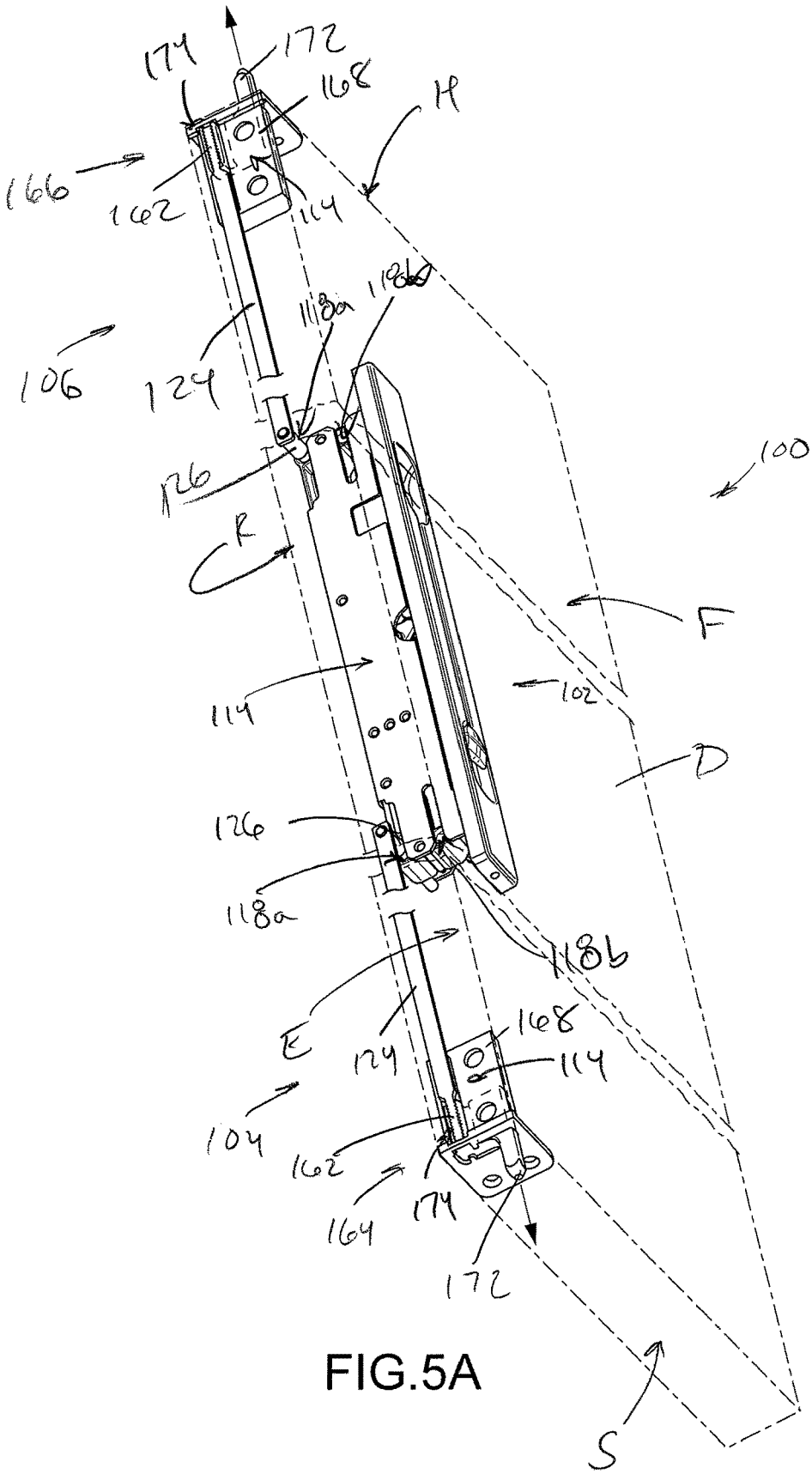
FIGS. 5A and 5B are partial perspective views of the lock of FIG. 2 in locked and unlocked positions, respectively, installed in a door panel.
Figure 5B:
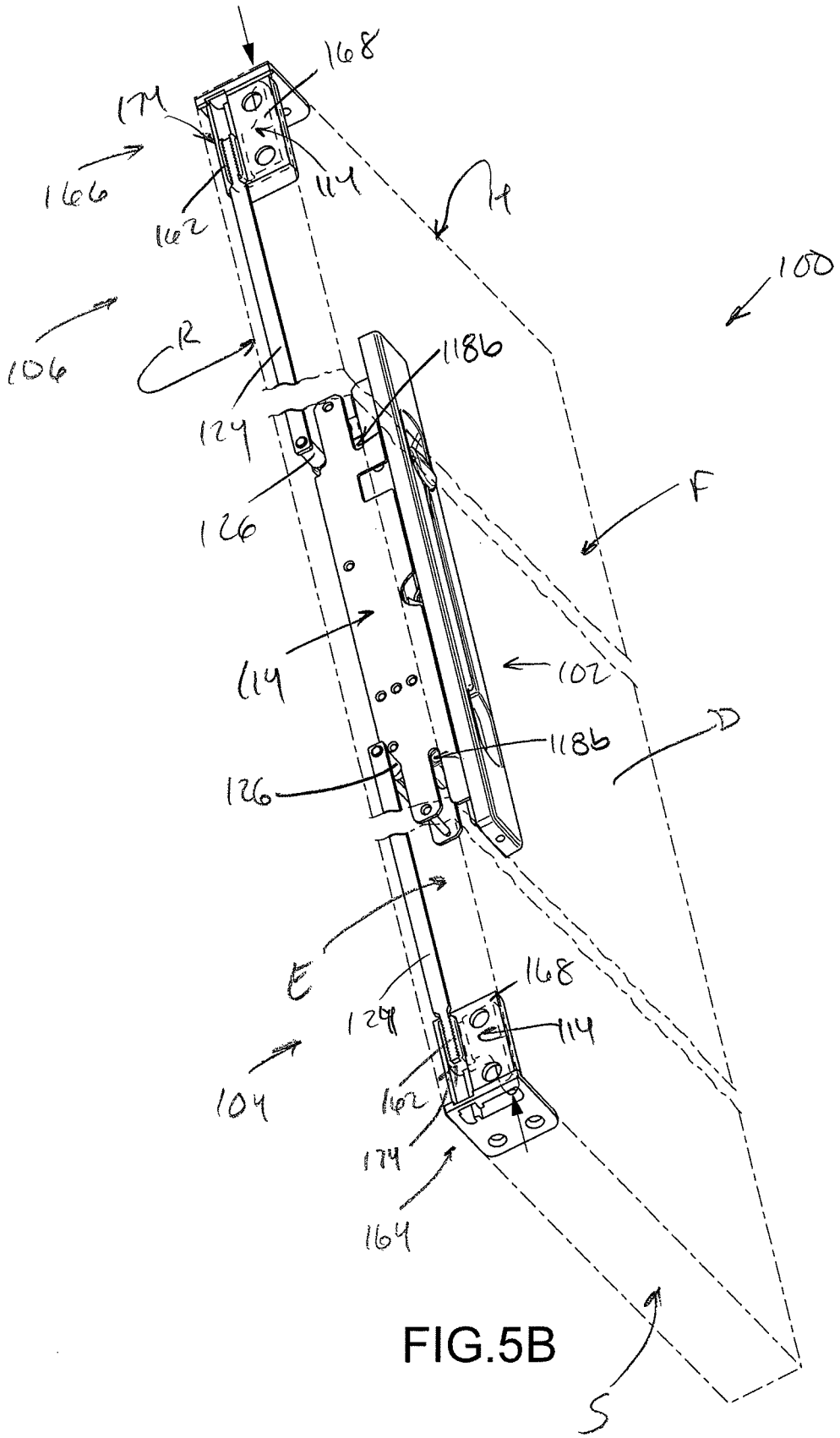

FIGS. 5A and 5B are partial perspective views of the lock 100 of FIG. 2 in locked and unlocked positions, respectively, installed in a door panel D. A number of elements are depicted above with regard to FIGS. 1 and 2 and as such are not necessarily described further. The door panel D and transmissions 104, 106 are depicted as broken to indicate that the lock 100 can be installed in a door panel D having any height. In that regard, the transmissions 104, 106 are field configurable (e.g., able to be cut or broken) so as to reach locking elements 164, 166 disposed at the top and bottom of a door that is 84 inches high, as well as a door that is 80 inches high, for example. In an example, the serrated tip 162 may extend up to about half of the total length of the bar 124, as to enable cutting to any length. Alternatively, the lock may be provided with a plurality of transmissions, each having bars of different lengths. The appropriately-sized bar may then be selected or further cut or broken to accommodate doors of various heights.

The lock actuator 102 is installed in a recess proximate a central portion of the vertical face F of the door panel D in the depicted example, although the lock actuator 102 may be installed at other locations. Additionally, although two locking elements 164, 166 are depicted, a single locking element with a single lock actuator 102 may also be utilized. In such a configuration, it may still be desirable to utilize a lock actuator having two sliders 120, 122, so as to properly balance forces attendant with operation of the actuator 102. The locking elements 164, 166 are installed within recesses in an edge E of the door panel, such that the tips 172 of the locking elements 164, 166 extend out of a head edge H and a sill edge S, respectively, of the door panel D. Slots are cut from the edge E of the door panel D so as to be in communication with the recess into which the lock actuator 102 is installed. Such slots are aligned with the post receivers (118*a* in FIGS. 5A and 5B) in each of the sliders 120, 122, and sized to receive the posts 126 from the transmissions 104, 106. In general, the slots are cut so as to be aligned with only one of the post receivers 118*a*, 118*b*, depending on the installation particulars. The transmissions 104, 106 are installed substantially parallel to and along the edge E of the door panel D, parallel to and on a transmission side 114 of both the lock actuator 102 and the locking elements 164, 166. Since the transmission bars 124 are installed external to the door panel D, the post 126 is inserted through the slot in the door edge E and into the post receiver 118*a*. The serrated tip 162 mates with the transmission receiver 174 on the shoot bolt, the tip 172 which extends from the housing 168.

FIGS. 5A and 5B, for example, depict transmission posts 126 installed in rearward post receivers 118*a* on the lock actuator 102 (more specifically on the sliders 120, 122). In this configuration, the shoot bolt tips 172 project from the housings 168 proximate the face F of the door panel D. Alignment of the transmission receiver 174 and the transmission bar 124 is ensured by installing the posts 126 into the rearward post receiver 118*a*. This installation is desirable for outward-swinging bi-fold doors (e.g., doors that move generally away from the operator of the door). Typically, bi-fold doors utilize a track proximate a head and/or sill of the door to guide the door during movement (a roller on one of a pair of bi-fold doors typically rolls in the track). By having the shoot bolt tip 172 offset from a center of the edge E of the door panel D, the shoot bolt tip 172 can avoid interference therewith. This offset tip 172 configuration may also be advantageous for use of the lock 100 on standard sliding doors, such as patio doors. FIG. 5B depicts the lever 134 moved to an unlocked position, which retracts the shoot bolt tips 172 substantially into the housings 168, thus enabling operation of the door.

Figure 6:
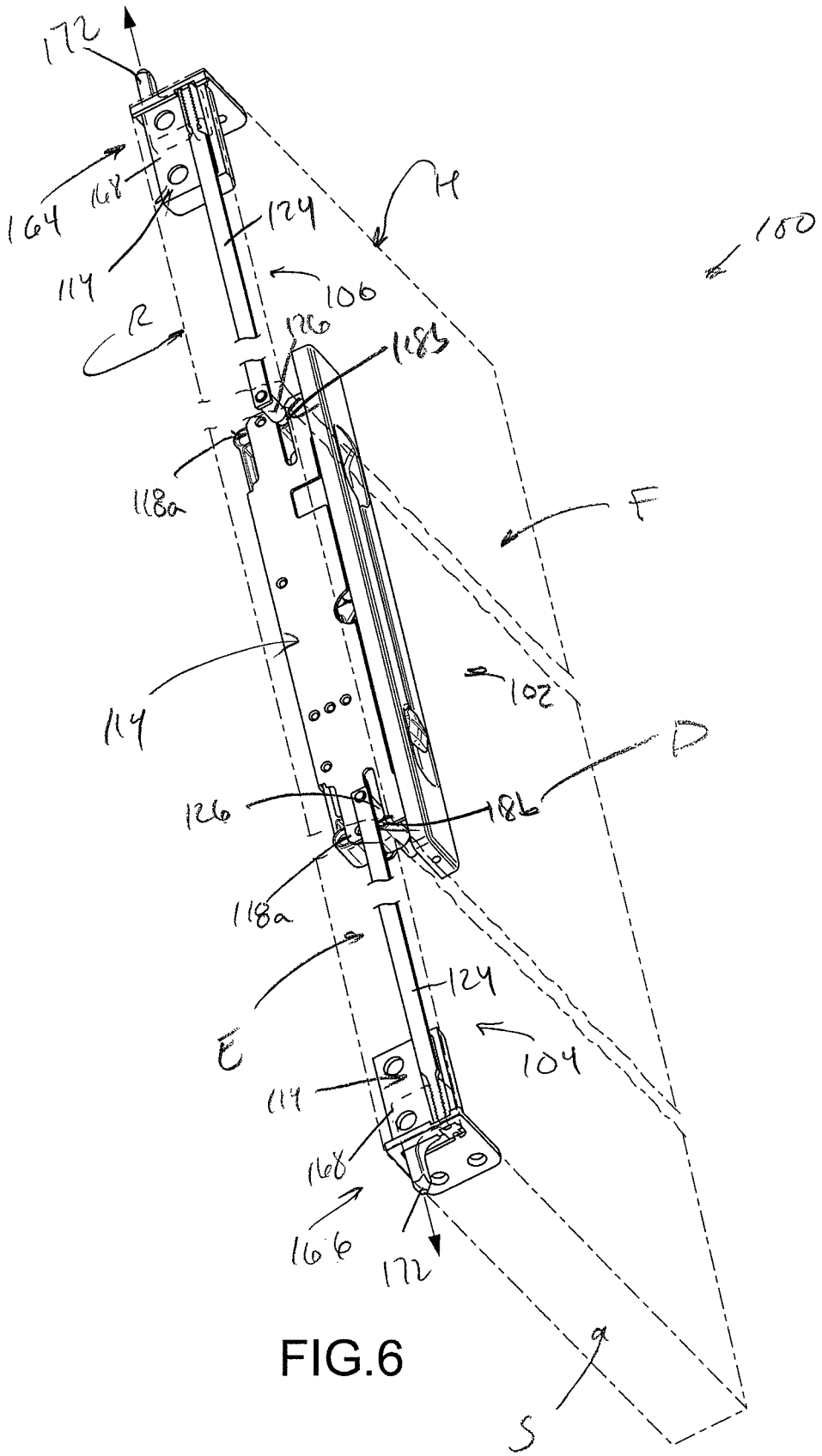
FIG. 6 is a partial perspective view of a lock.

FIG. 6 depicts a partial perspective view of the lock 100 of FIG. 2 in a locked position. Unlike the example of FIGS. 5A and 5B, the shoot bolt tips 172 of the locking elements 164, 166 extend from the housings 168 proximate a rear face R of the door panel D. As described above, the locking elements 164, 166 are mirror images of each other. As such, in order to configure the lock 100 as depicted in FIG. 6 (notably, where the shoot bolt tips 172 are disposed proximate the rear face R of the door panel D), locking element 164 is installed proximate the head edge H of the door panel D, while locking element 166 is installed proximate the sill edge S of the door panel D. Alignment of the transmission receivers 174 and the transmission bars 124 is ensured by installing the posts 126 into a forward post receiver 118*b*. This configuration may be desirable for inswing doors, where the door panel swings towards the operator of the door. By having the shoot bolt tip 172 offset from a center of the edge E of the door panel D, the shoot bolt tip 172 can avoid interference with tracks or other door hardware.

Figure 7A:
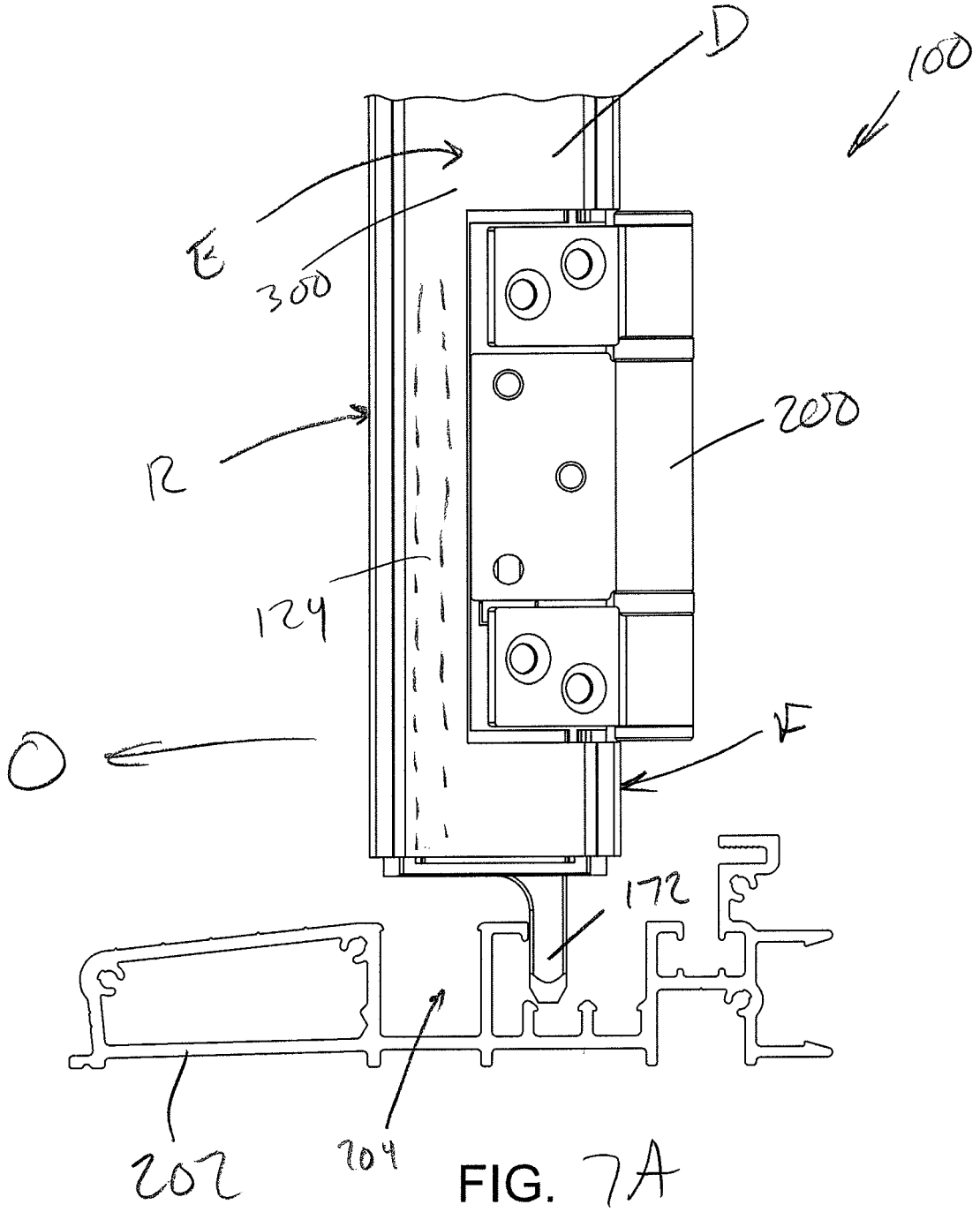
FIGS. 7A and 7B depict enlarged partial side views a lock interface.
Figure 7B:
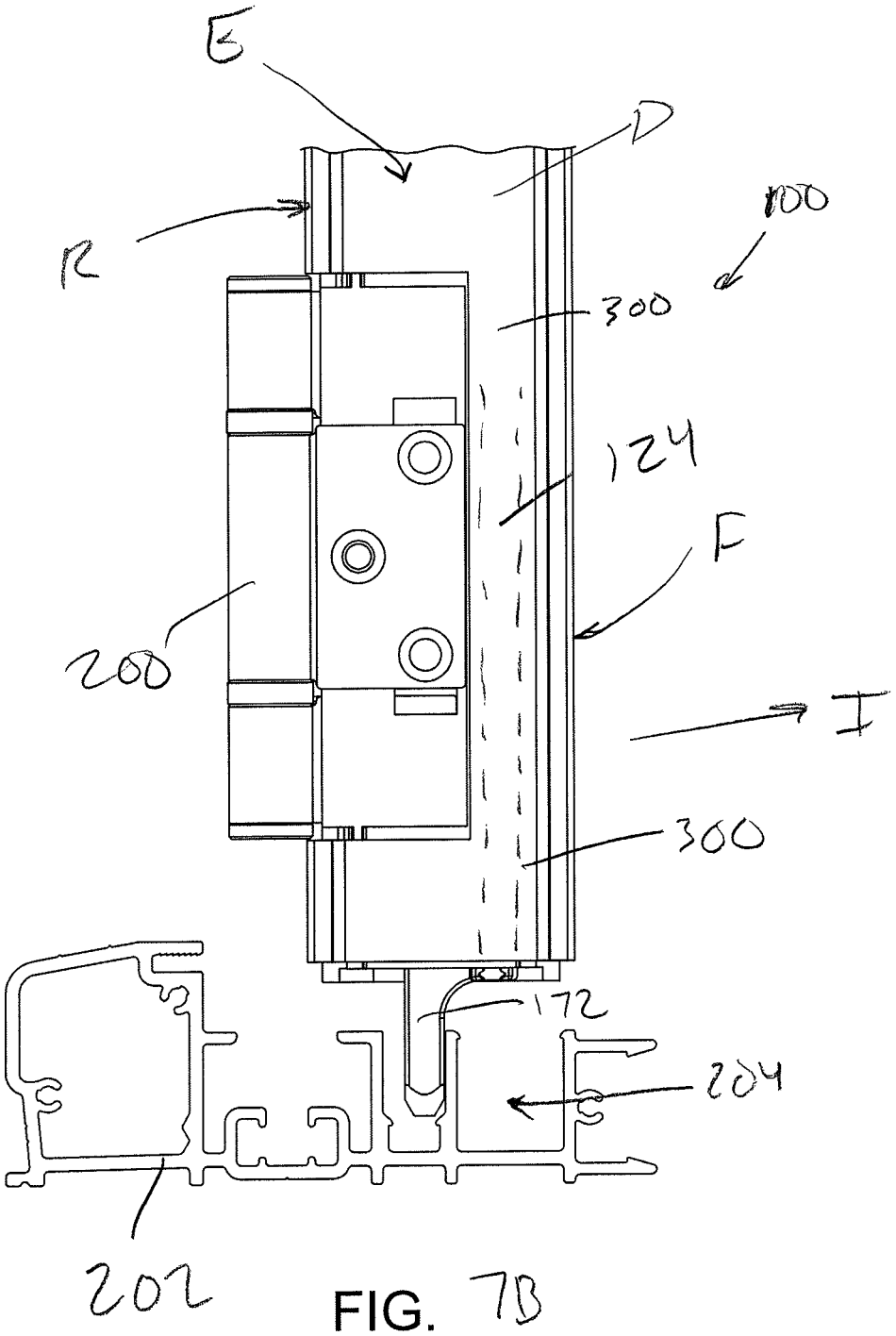

FIGS. 7A and 7B depict enlarged partial side views a lock 100 interface. More specifically, FIG. 7A depicts a bottom locking element 166 with a tip 172 of a shoot bolt extending therefrom. The position of the hinge 200 indicates that the door panel D, with a locking element 166 so installed, is configured to pivot outward O, away from a door operator, as described above in FIGS. 5A and 5B. As such, the tip 172 extends from the shoot bolt housing proximate the face F of the door panel D. In this configuration, the bar 124 is hidden below a cover 300 (described in more detail below) on the edge E of the door panel D, between the rear R of the door panel D and the hinge 200. This allows the tip 172 to extend into the sill 202 in the desired location. In the depicted sill configuration, rollers are mounted in the track 204. As such, the configuration of the tip 172 allows the lock to operate without interfering with any components in the track 204.

FIG. 7B depicts a bottom locking element 166 with a tip 172 of a shoot bolt extending therefrom. The position of the hinge 200 indicates that the door panel D, with a locking element 166 so installed, is configured to pivot inward I, towards a door operator, as described above in FIG. 6. As such, the tip 172 extends from the shoot bolt housing nearly at the centerline of the door panel D. In this configuration, the bar 124 is hidden below a cover 300 (described in more detail below) on the edge E of the door panel D, between the face F of the door panel D and the hinge 200. This allows the tip 172 to extend into the sill 202 in the desired location. In the depicted sill configuration, rollers are mounted in the track 204. As such, the configuration of the tip 172 allows the lock to operate without interfering with any components in the track 204.

Figure 8:
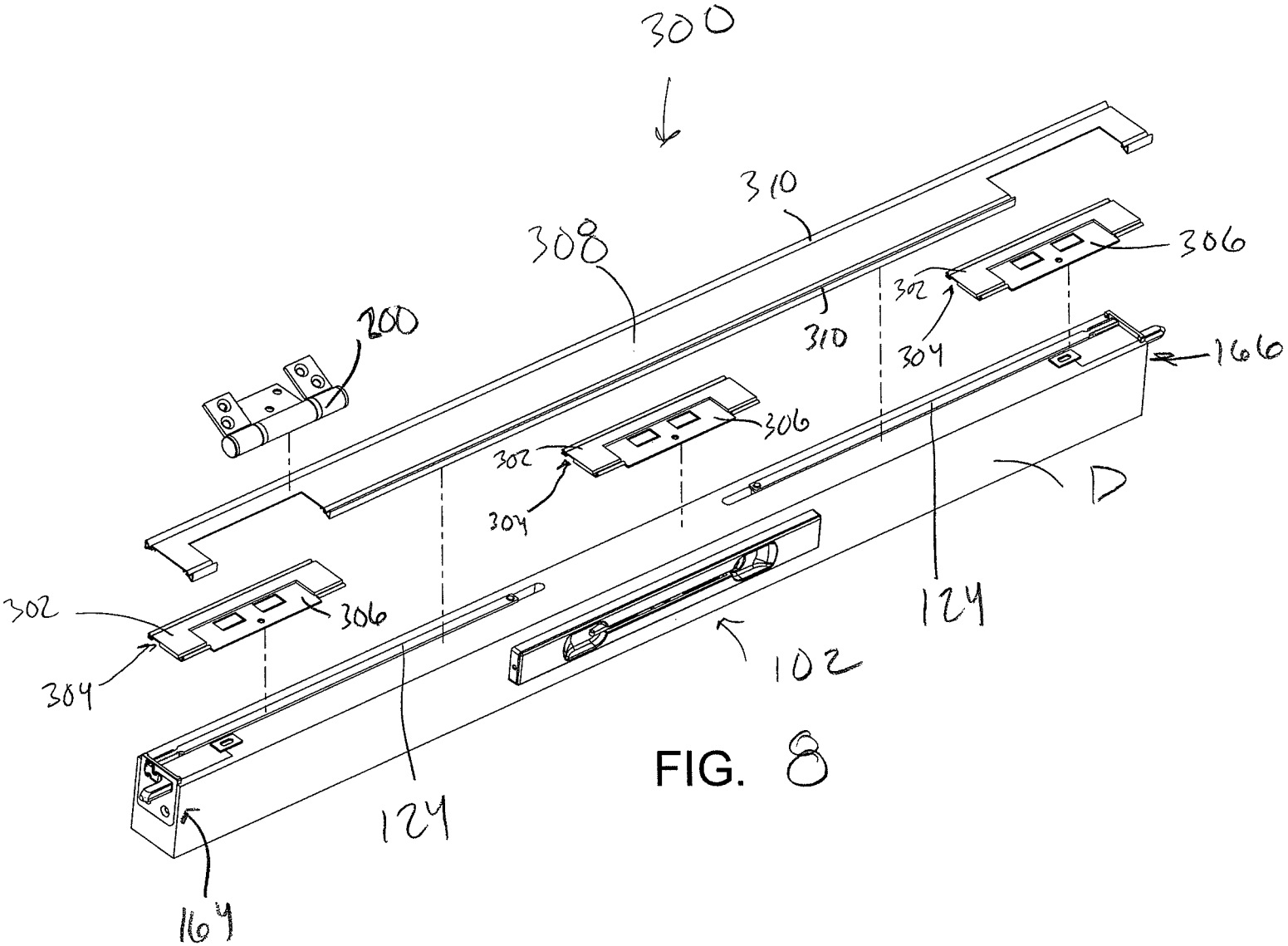
FIG. 8 depicts an exploded perspective view of a securing and sealing assembly for the locks of FIGS. 5A-7B.

FIG. 8 depicts an exploded perspective view of a securing and sealing assembly 300 for the locks 100 of FIGS. 5A-7B. As described elsewhere herein, the lock 100 includes an actuator 102, two locking elements 164, 166 and bars 124 that enable operation or the locking elements 164, 166 via the actuator 102. The securing and sealing assembly may include a chase 302 that at is configured to cover at least a portion of the bar 124. The chase 302 can include a slot 304 in which the bar 124 moves and may be secured in place by one or more screws. The chase 302 defines a mounting location 306 for the hinge 200. Screws utilized to secure the hinge 200 may also be utilized to secure the chase 302. A cover 308 may be installed over the chase 302 for aesthetic or other purposes. For example, the cover 308 may include one or more lengths of weather-stripping 310, which may be of a bulb, foam, or pile. In other examples, the chase 302 and the cover 308 may be integrated into a single component.

Figure 9:
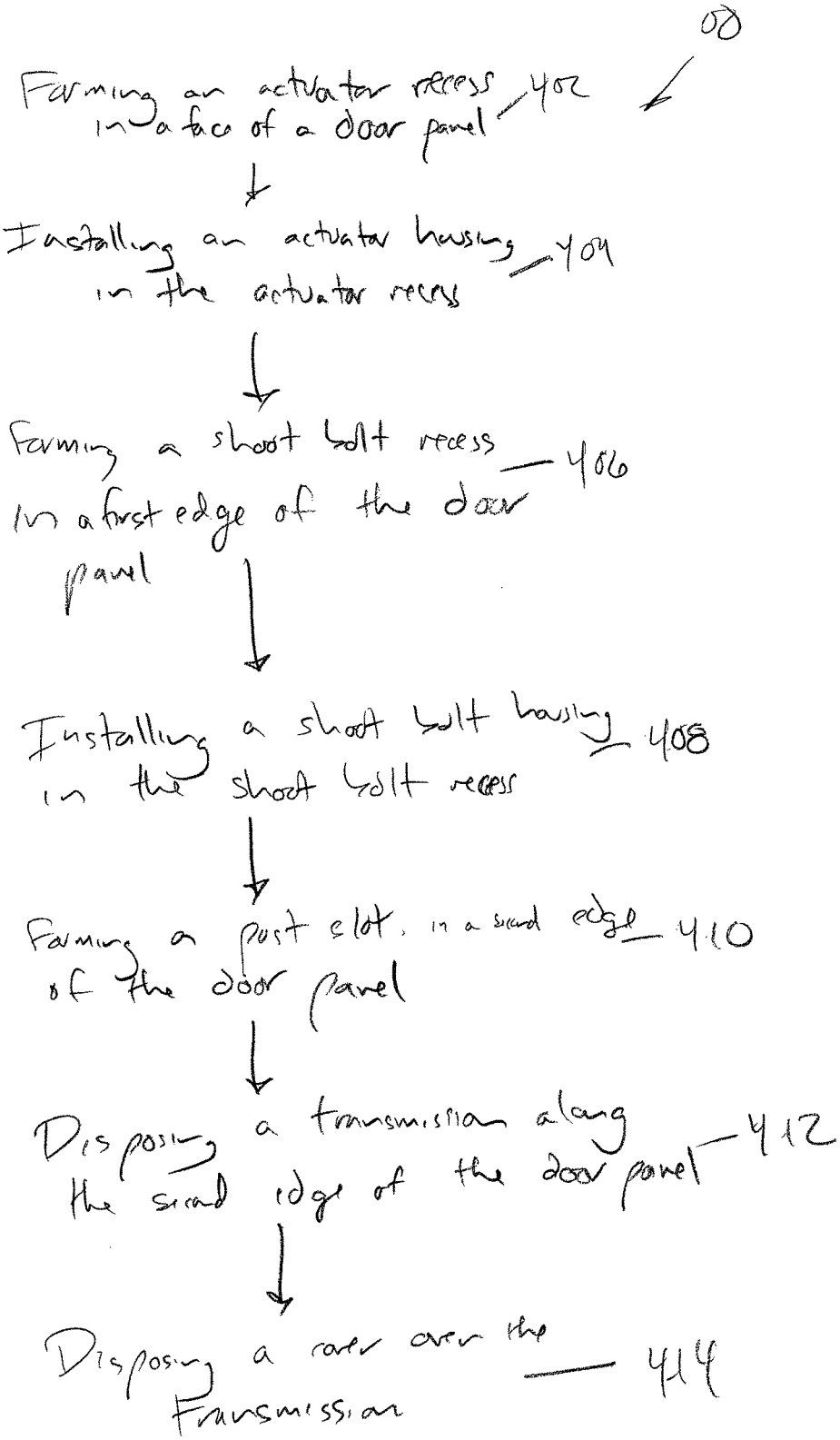
FIG. 9 depicts a method of installing a lock.

FIG. 9 depicts a method 200 of installing a lock in a door panel. The method 400 begins by forming an actuator recess in a face of the door panel, operation 402. In operation 404, a lock actuator having a housing may be installed in the actuator recess. In operation 406, a shoot bolt recess is formed in a first edge of the door panel. This first edge may be a head edge or a sill edge of the door panel, for example. A locking element such as a shoot bolt disposed in a shoot bolt housing is installed in the shoot bolt recess in operation 408. The locking element is installed such that a portion of the shoot bolt (e.g., a transmission receiver) projects beyond a second edge of the door panel. This second edge of the door is substantially orthogonal to both the first edge and the face of the door panel. By projecting beyond the second edge of the door panel, the transmission receiver may receive a portion of the transmission once that component is installed. Operation 410 includes forming a post recess in the second edge of the door, proximate the actuator housing. The post slot is formed so as to be in communication with the actuator recess. In operation 412, a transmission is disposed along the second edge of the door panel, exterior to the panel. In doing so, a post of the transmission penetrates the post slot and is connected to a post receiver on the actuator. Additionally, an end of the transmission may be inserted into the transmission receiver of the shoot bolt. The transmission may be covered by a cover in operation 414, which can help keep the transmission from coming loose from the edge of the door. In other examples, operation 414 may include installing a chase over the transmission. The operations in this method 400 may be performed in any order. In examples, all of the slots and recesses are first formed in the door panel, then the various components of the lock installed.

The materials utilized in the manufacture of the locks described herein may be those typically utilized for lock manufacture, e.g., zinc, steel, aluminum, brass, stainless steel, etc. Molded plastics, such as PVC, polyethylene, etc., may be utilized for the various components. Material selection for most of the components may be based on the proposed use of the mounting system. Appropriate materials may be selected for mounting systems used on particularly heavy panels, as well as on hinges subject to certain environmental conditions (e.g., moisture, corrosive atmospheres, etc.).

The terms first, second, face, rear, head, sill, top, bottom, panel, edge, header, sill, etc., as used herein, are relative terms used for convenience of the reader and to differentiate various elements of the lock from each other. In general, unless otherwise noted, the terms are not meant to define or otherwise restrict location of any particular element.

While there have been described herein what are to be considered exemplary and preferred examples of the present technology, other modifications of the technology will become apparent to those skilled in the art from the teachings herein. The particular methods of manufacture and geometries disclosed herein are exemplary in nature and are not to be considered limiting. It is therefore desired to be secured in the appended claims all such modifications as fall within the spirit and scope of the technology. Accordingly, what is desired to be secured by Letters Patent is the technology as defined and differentiated in the following claims, and all equivalents.

What is claimed is:

1. An apparatus comprising:

a faceplate;

an actuator housing coupled to the faceplate and comprising a transmission side, wherein the transmission side defines a pair of transmission slots, and wherein the pair of transmission slots comprise a first transmission slot disposed proximate the faceplate and an opposite second transmission slot disposed away from the faceplate;

a slider assembly at least partially disposed in the actuator housing, wherein the slider assembly comprises a first slider and a second slider, wherein the first slider comprises a first end and a second end, wherein the second end defines a pair of post receivers, wherein the slider assembly is movable between a first position and a second position, and wherein the pair of post receivers is aligned with the pair of transmission slots when the slider assembly is in the first position and the second position;

wherein the first slider and the second slider are operatively connected to each other at their respective first end;

a lever pivotably connected to the actuator housing and disposed on the second slider to move the slider assembly between the first position and the second position;

a transmission comprising:

an elongated element comprising a first end and a second end, wherein the elongated element is disposed outside the actuator housing and substantially parallel to and proximate the transmission side; and a post coupled to the first end of the elongate element and received in one of the pair of post receivers of the first slider via a corresponding transmission slot of the pair of transmission slots, the post spacing the elongated element from the housing; and a latching element coupled to the second end of the elongate element, the latching element moving between a latching position and an unlatching position with respect to the movement of the slider assembly between the first position and the second position.

2. The apparatus of claim 1, wherein the latching element comprises a shoot bolt connected to the second end of the elongated element.

3. The apparatus of claim 2, wherein the shoot bolt defines a transmission receiver for receiving at least a portion of the elongate element.

4. The apparatus of claim 3, wherein the portion of the elongate element comprises a serration configured to couple to a corresponding serration of the transmission receiver.

5. The apparatus of claim 3, wherein the latching element further comprises a shoot bolt housing, wherein the shoot bolt is slidably disposed in the shoot bolt housing.

6. The apparatus of claim 5, wherein the transmission receiver projects from a transmission side of the shoot bolt housing.

7. The apparatus of claim 6, wherein the transmission side of the shoot bolt housing is substantially parallel to the transmission side of the actuator housing.

8. The apparatus of claim 5, wherein the shoot bolt is configured to substantially extend from the shoot bolt housing when the slider assembly is in the first position and wherein the shoot bolt is configured to substantially retract into the shoot bolt housing when the slider assembly is in the second position.

9. The apparatus of claim 1, wherein the lever comprises a handle and an opposite drive, wherein the slider assembly comprises a drive slot, and wherein the drive is at least partially disposed within the drive slot.

10. The apparatus of claim 1, wherein the first slider comprises a first rack disposed proximate the first end of the first slide and the second slider comprises a second rack disposed proximate the first end of the second slider, and wherein a gear engages with the first rack of the first slider and the second rack of the second slider.

11. The apparatus of claim 1, wherein the transmission is a first transmission, the elongated element is a first elongated element, the post is a first post, the pair of transmission slots is a first pair of transmission slots, and the latching element is a first latching element, the apparatus further comprising:

a second transmission comprising:

a second elongated element disposed outside the actuator housing and substantially parallel to and proximate the transmission side; and a second post connected to the second elongate element at a first end of the second elongated element and received in one of a pair of post receivers of the second slider via a corresponding transmission slot of a second pair of transmission slots, the post spacing the elongated element from the housing; and a second latching element coupled to the second end of the elongate element.

12. An apparatus comprising:

an actuator housing comprising opposing transmission sides, wherein each of the transmission sides defines a first pair of transmission slots and an opposite spaced second pair of transmission slots;

a pair of sliders disposed in the actuator housing, wherein each slider comprises a rack disposed proximate a first end and a pair of post receivers disposed proximate a second end, wherein the first pair of transmission slots and the second pair of transmission slots each align with a respective one of the pair of post receivers;

a gear engaged with both the rack of the first slider and the rack of the second slider;

a lever pivotably connected to the actuator housing and disposed on the second slider, wherein the lever is movable between a first position and a second position;

a pair of shoot bolt housings, each comprising a transmission side, wherein each of the shoot bolt housings are disposed remote from the actuator housing;

a shoot bolt slidably disposed in each of the shoot bolt housings, wherein the shoot bolts each comprise a transmission receiver projecting from the transmission side of the shoot bolt housing;

a first transmission engaged with one of the pair of post receivers on a first of the pair of sliders and the transmission receiver on a first of the pair of shoot bolts, wherein the first transmission is disposed between one of the transmission sides of the actuator housing and the transmission receiver on a first shoot bolt housing of the pair of shoot bolt housings; and a second transmission engaged with one of the pair of post receivers on a second of the pair of sliders and the transmission receiver on a second of the pair of shoot bolts, wherein the second transmission is disposed between the other one of the transmission sides of the actuator housing and the transmission receiver on a second shoot bolt housing of the pair of shoot bolt housings.

13. The apparatus of claim 12, wherein each transmission comprises an elongate element having a serrated end, and wherein each transmission receiver comprises a recess configured to mate with the serrated end.

14. The apparatus of claim 12, further comprising a cover defining a channel, wherein the channel is configured to at least partially receive at least one of the first transmission and the second transmission:

when the actuator housing and the pair of shoot bolt housings are installed in a door panel; and when the first transmission and the second transmission are disposed external to an edge of the door panel.

15. The apparatus of claim 12, further comprising a lock for selectively locking the lever in the first position.

* * * * *